US008905502B2

(12) United States Patent
Kim

(10) Patent No.: US 8,905,502 B2
(45) Date of Patent: Dec. 9, 2014

(54) REFRIGERATOR

(71) Applicant: Jubaeg Kim, Changwon-si (KR)

(72) Inventor: Jubaeg Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 160 days.

(21) Appl. No.: 13/660,410

(22) Filed: Oct. 25, 2012

(65) Prior Publication Data

US 2013/0105497 A1 May 2, 2013

(30) Foreign Application Priority Data

Oct. 26, 2011 (KR) ..... 10-2011-0109645

(51) Int. Cl.
*F25D 17/04* (2006.01)
*B65D 81/38* (2006.01)

(52) U.S. Cl.
CPC ..... *B65D 81/38* (2013.01); *F25D 17/047* (2013.01)
USPC ..... 312/406.1; 312/401; 62/410

(58) Field of Classification Search
CPC ..... F25D 23/02; F25D 23/028; F25D 23/062; F25D 23/064–23/066; F25D 2323/024; F25D 2400/04; F25D 2400/06; F25D 2201/14; F25D 17/04; F25D 17/042; F25D 17/047; F25D 3/04; F24F 12/006; F24F 13/075; E05Y 2900/31; E05G 1/00; E05G 1/024; B65B 25/041; B65D 88/14; B65D 88/38
USPC ..... 312/401, 405, 406, 406.1, 407.1, 409; 62/410, 412
See application file for complete search history.

(56) References Cited

U.S. PATENT DOCUMENTS

| | | | | |
|---|---|---|---|---|
| 1,275,557 | A * | 8/1918 | Hamilton et al. | 137/542 |
| 2,564,023 | A * | 8/1951 | Miller | 137/533.17 |
| 3,952,542 | A * | 4/1976 | Berkowitz | 62/409 |
| 4,257,445 | A * | 3/1981 | Cook et al. | 137/341 |
| 6,672,096 | B2 * | 1/2004 | Lopes | 62/331 |
| 2009/0199588 | A1 * | 8/2009 | Laible | 62/449 |

FOREIGN PATENT DOCUMENTS

DE 102006040381 A1 * 3/2008 ..... F25D 21/04

* cited by examiner

*Primary Examiner* — Darnell Jayne
*Assistant Examiner* — Ryan A Doyle
(74) *Attorney, Agent, or Firm* — McKenna Long & Adridge LLP

(57) ABSTRACT

A refrigerator includes a pressure adjustment device that passes through an inner case and an outer case such that the inside and outside of the refrigerator communicate with each other, and the pressure adjustment device is opened and closed according to opening and closing of a door so as to remove a pressure difference between the inside and outside of the refrigerator, thereby facilitating opening of the door.

7 Claims, 8 Drawing Sheets

REFRIGERATOR

CROSS-REFERENCE TO RELATED APPLICATIONS

The present application claims the benefit of priority under 35 U.S.C. 119 to Korean Patent Application No. 10-2011-0109645 filed on Oct. 26, 2011 which is hereby incorporated by reference in its entirety.

BACKGROUND

The present disclosure relates to a refrigerator.

Refrigerators are electric appliances for storing food at a low temperature in a storage space closed by a refrigerator door. The storage space is cooled using cold air generated through heat exchange with refrigerant circulating through a refrigeration cycle, thereby optimally storing food.

Along with the change of people's eating patterns and preference, large and multifunctional refrigerators have been introduced, and various comfortable structures have been added to refrigerators.

In general, a temperature difference between the inside and outside of a refrigerator ranges from about 20° C. to about 40° C. In this case, the inside of the refrigerator, which is lower in temperature than the outside thereof, is lower in pressure than the outside thereof, and thus, opening of the refrigerator door may be difficult. Moreover, opening of the refrigerator door may be more difficult due to attraction of a magnet provided on a gasket disposed between the refrigerator door and a cabinet providing the storage space.

To address this issue, outer air may be introduced into the refrigerator through a passage disposed in the refrigerator for discharging defrosted water from an evaporator, thereby removing a pressure difference between the inside and outside of the refrigerator.

Such configurations are disclosed in Korean Patent Publication Nos. 10-1999-0048798, 10-2006-0128590, and 10-2009-0130526.

However, in this case, the defrosted water discharge passage is used as the passage for connecting the inside and outside of the refrigerator. Thus, unless the refrigerator includes a structure for discharging defrosted water from the evaporator through a defrosting operation, it may be difficult to remove the pressure difference between the inside and outside of the refrigerator.

In particular, it may be difficult to apply a pressure difference removing structure to a direct cooling-type refrigerator that does not defrost the evaporator. Thus, opening of the refrigerator door may be difficult due to the pressure difference.

Furthermore, the pressure difference removing structure is disposed in a machinery room or a refrigerator main body, and thus, assembling thereof is complicated and a repair service is difficult.

SUMMARY

Embodiments provide a refrigerator including a pressure adjustment device that passes through an inner case and an outer case such that the inside and outside of the refrigerator communicate with each other, and the pressure adjustment device is opened and closed according to opening and closing of a door so as to remove a pressure difference between the inside and outside of the refrigerator.

In one embodiment, a refrigerator includes: a cabinet providing a storage space that is opened and closed by a door; and a pressure adjustment device disposed at the cabinet, wherein an inside of the refrigerator communicates with an outside thereof through the pressure adjustment device so as to remove a pressure difference between the inside and outside of the refrigerator when the door is opened, wherein the pressure adjustment device includes: a connecting tube passing through the cabinet; a main tube coupled to the connecting tube from an outside of the cabinet; and an opening/closing unit disposed within the main tube to open and close a passage of the pressure adjustment device.

The cabinet may include: an outer case forming an appearance of the refrigerator; an inner case coupled to the outer case and forming the storage space; a thermal insulator disposed in a space between the inner case and the outer case, wherein the connecting tube is embedded in the thermal insulator.

The connecting tube may include: a first fixing part at an end thereof, which extends along a periphery of the connecting tube; a second fixing part at the end thereof, which is spaced apart from the first fixing part and is extended from an outer surface of the connecting tube and is passed through the inner case; and an insertion part disposed between the first fixing part and the second fixing part to receive the inner case.

The second fixing part may have a plate shape extending in opposite directions, and the inner case including an insertion hole having a shape corresponding to the second fixing part such that the insertion part is fixed to the inner case by inserting the second fixing part into the insertion hole and rotating the second fixing part.

The connecting tube may include: an extension part at an end thereof, which protrudes through a through hole disposed in the outer case forming a rear surface of the cabinet; and a support part at the end thereof, which extends along a periphery of the connecting tube.

A thermal insulating member may be disposed between the outer case and the support part to thermally insulate the connecting tube and the outer case from each other.

An end of the connecting tube may protrude through a through hole of the outer case forming a rear surface of the cabinet, and a flange bent toward an inside of the cabinet may be disposed around the through hole of the outer case.

A thermal insulating member may be disposed between the flange and a peripheral surface of the connecting tube to prevent thermal conduction between the connecting tube and the outer case.

The main tube may be connected to an end of the connecting tube protruding through the outer case.

The main tube may include: a horizontal part provided with a connecting part that is disposed outside of the cabinet and is inserted into an end of the connecting tube; and a vertical part bent downward from the horizontal part, wherein the opening/closing unit for opening and closing an air passage is disposed in the vertical part.

The opening/closing unit may include: a valve cap that includes a guide shaft and an open passage, wherein the guide shaft is inserted into the vertical part from a lower side thereof, and is extended upward, and the open passage through which air flows is disposed outside of the guide shaft; and a shutter vertically moving along the guide shaft to selectively open and close the open passage.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to embodiments of the present disclosure, examples of which are illustrated in the accompanying drawings. The spirit and scope of the present disclosure, however, shall not be construed as being limited to embodiments provided herein. Rather, it will be apparent that other embodiments that fall within the spirit and scope of the present disclosure may be easily derived through adding, modifying, and deleting elements herein.

Figure 1:
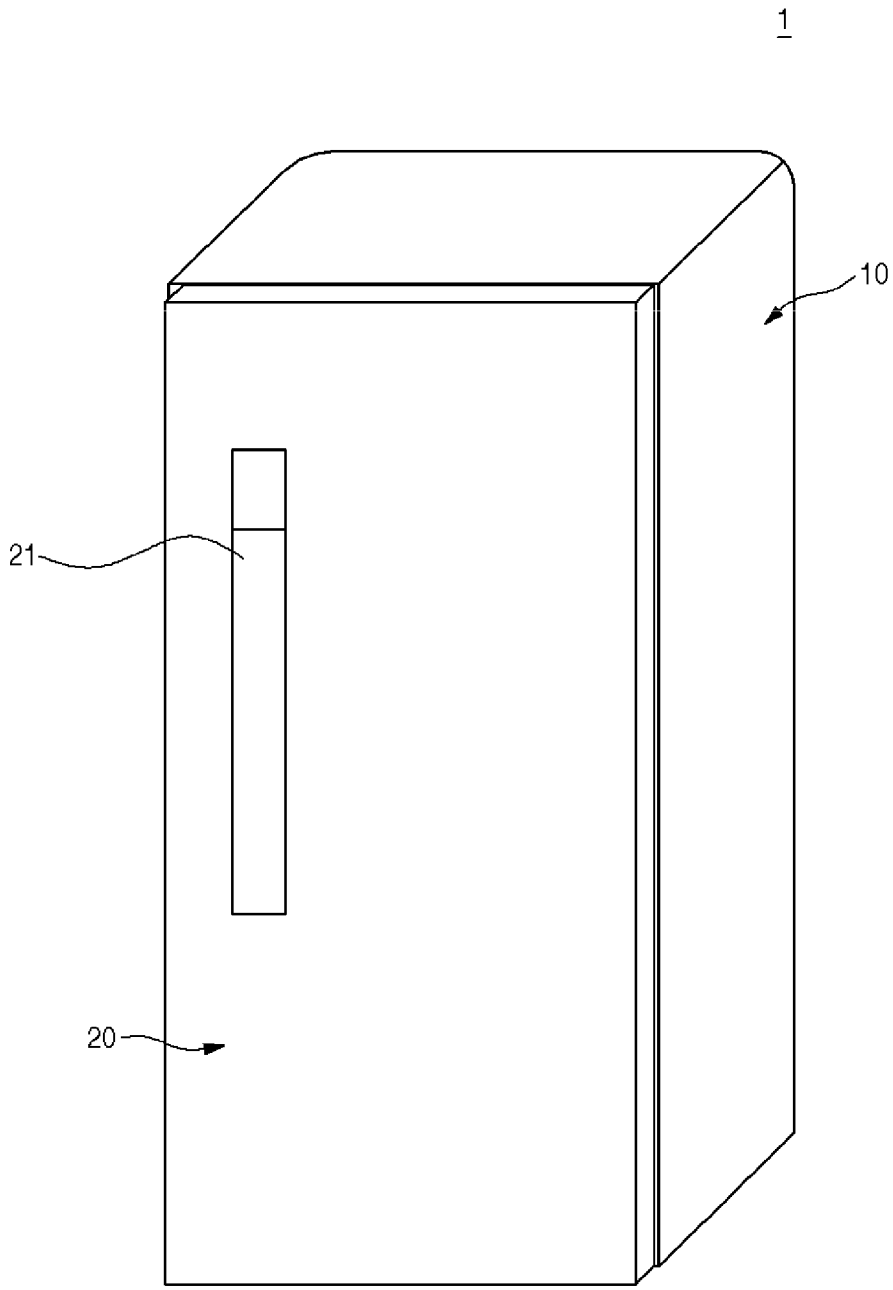
FIG. 1 is a perspective view illustrating a refrigerator according to an embodiment.
Figure 2:
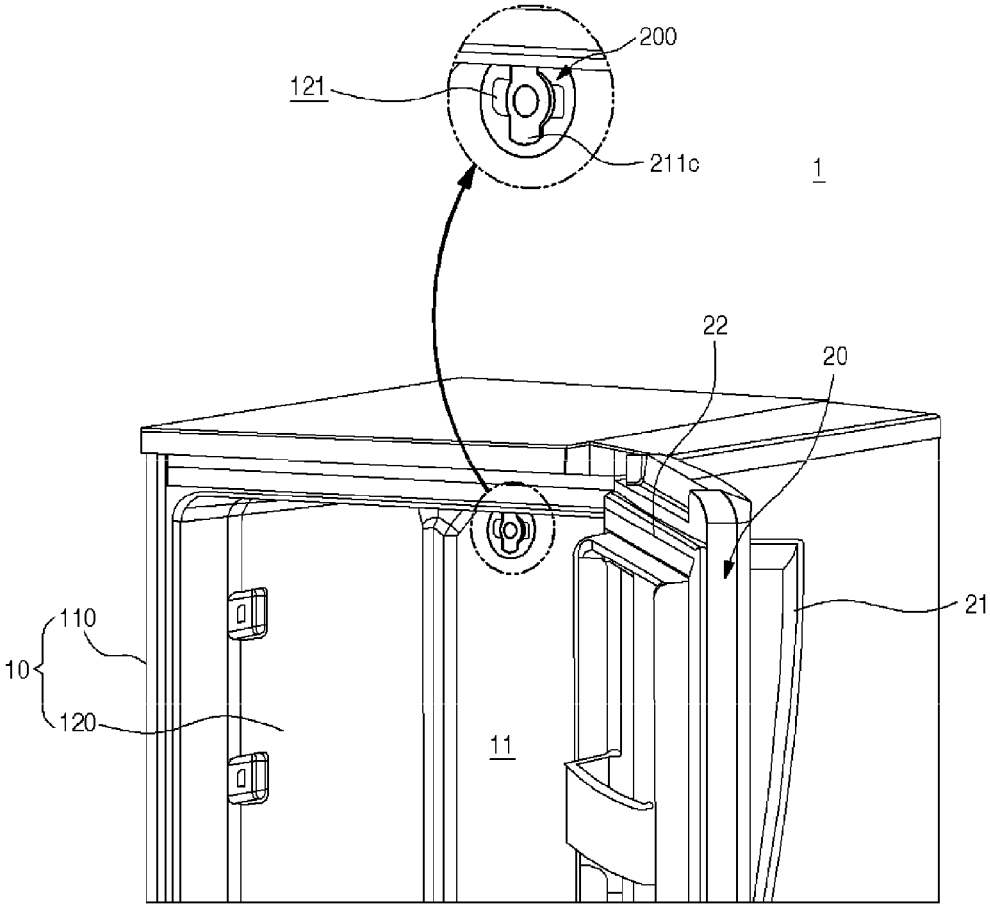
FIG. 2 is a partial perspective view illustrating the refrigerator of FIG. 1 with a door opened.

FIG. 1 is a perspective view illustrating a refrigerator according to an embodiment. FIG. 2 is a partial perspective view illustrating the refrigerator of FIG. 1 with a door opened.

Referring to FIGS. 1 and 2, the refrigerator 1 according to the current embodiment may include a cabinet 10 providing a storage space 11, and a door 20 opening and closing the storage space 11. The cabinet 10 and the door 20 may form an appearance of the refrigerator 1.

The cabinet 10 includes: an outer case 110 forming the appearance of the refrigerator 1; and an inner case 120 forming the storage space 11. A space between the outer case 110 and the inner case 120 is filled with a thermal insulator through a foaming process, thereby thermally insulating the inner space of the refrigerator 1 from the outside.

In particular, the outer case 110 is made of steel or other metal to form an outer surface of the cabinet 10, and the inner case 120 is made of synthetic resin, e.g., through injection molding for forming the storage space 11. A periphery of the outer case 110 is coupled to a periphery of the inner case 120, and surfaces of the outer case 110 are spaced apart from surfaces of the inner case 120 to form an inner space. A foaming agent is injected into the inner space between the outer case 110 and the inner case 120 to fill the inner space, thereby forming a thermal insulator 130.

The door 20 is rotatably installed on the cabinet 10, and the storage space 11 is opened and closed according to rotations of the door 20. A handle 21 is disposed on a front surface of the door 20 to efficiently rotate the door 20. An accommodation member such as a basket may be disposed on a rear surface of the door 20. A gasket 22 may be disposed around the rear surface of the door 20. A magnet is disposed within the gasket 22. Thus, when the door 20 is closed, the gasket 22 tightly contacts a front end of the cabinet 10.

A plurality of shelves or drawers are disposed in the storage space 11. Thus, the inner case 120 may have a shape on which shelves or drawers are installed.

Although not shown in detail, a machinery room as a space separated from the storage space 11 may be disposed in an inner lower portion of the cabinet 10 corresponding to an outside of the storage space 11. A plurality of components including a compressor operating on a refrigeration cycle may be disposed in the machinery room. When the refrigerator 1 is small, refrigerant tubes constituting an evaporator may be disposed outside of the inner case 120 to directly cool the inner space of the refrigerator 1. The configuration of the refrigeration cycle and the arrangement of the refrigerant tubes are the same as those of a typical direct cooling-type refrigerator, and thus, a detailed description and a drawing thereof will be omitted.

A pressure adjustment device 200 is disposed at the upper side of the cabinet 10. When opening of the door 20 is started from a closed state, the pressure adjustment device 200 introduces outside air to further facilitate the opening of the door 20. When the door 20 is closed, the pressure adjustment device 200 is closed to prevent leakage of cold air from the refrigerator 1. Only when the door 20 is opened, the pressure adjustment device 200 is opened to facilitate the opening of the door 20 even in the case where a pressure difference occurs between the inside and outside of the refrigerator 1.

The outside of the refrigerator 1 communicates with the inside thereof through the pressure adjustment device 200 that may pass through the outer case 110 and the inner case 120. Accordingly, an inlet of the pressure adjustment device 200 is disposed at the inside of the refrigerator 1, and an outlet thereof is disposed at the outside of the refrigerator 1.

The pressure adjustment device 200 will now be described in more detail with reference to the accompanying drawings.

Figure 3:
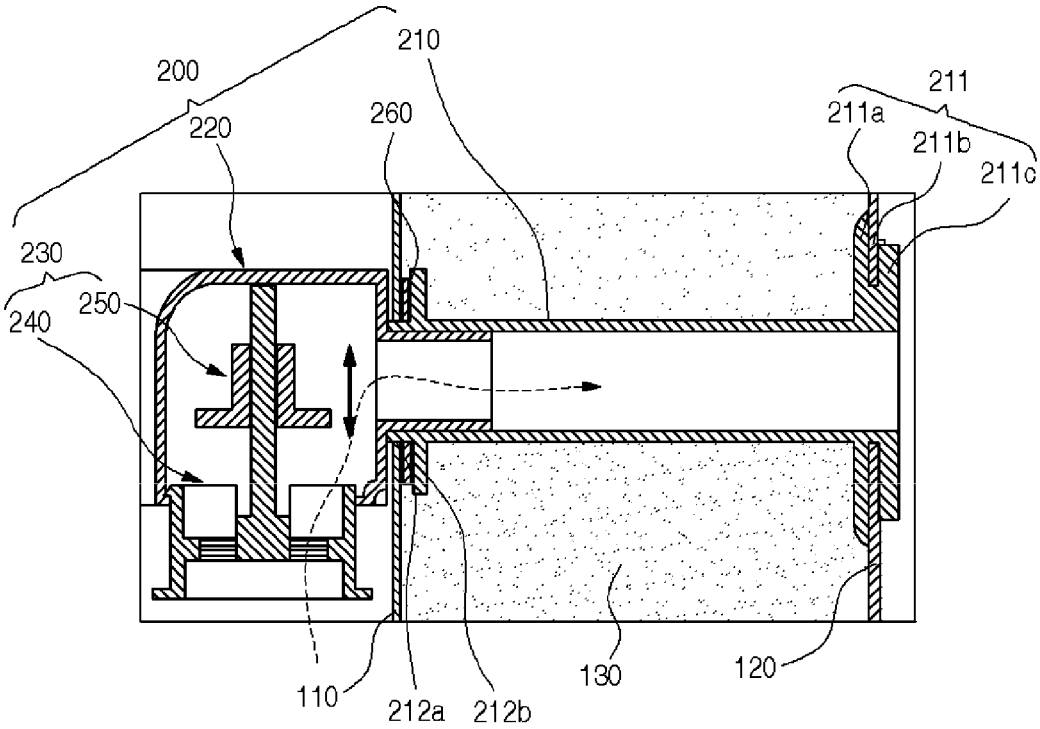
FIG. 3 is a cross-sectional view illustrating an installation state of a pressure adjustment device according to an embodiment.
Figure 4:
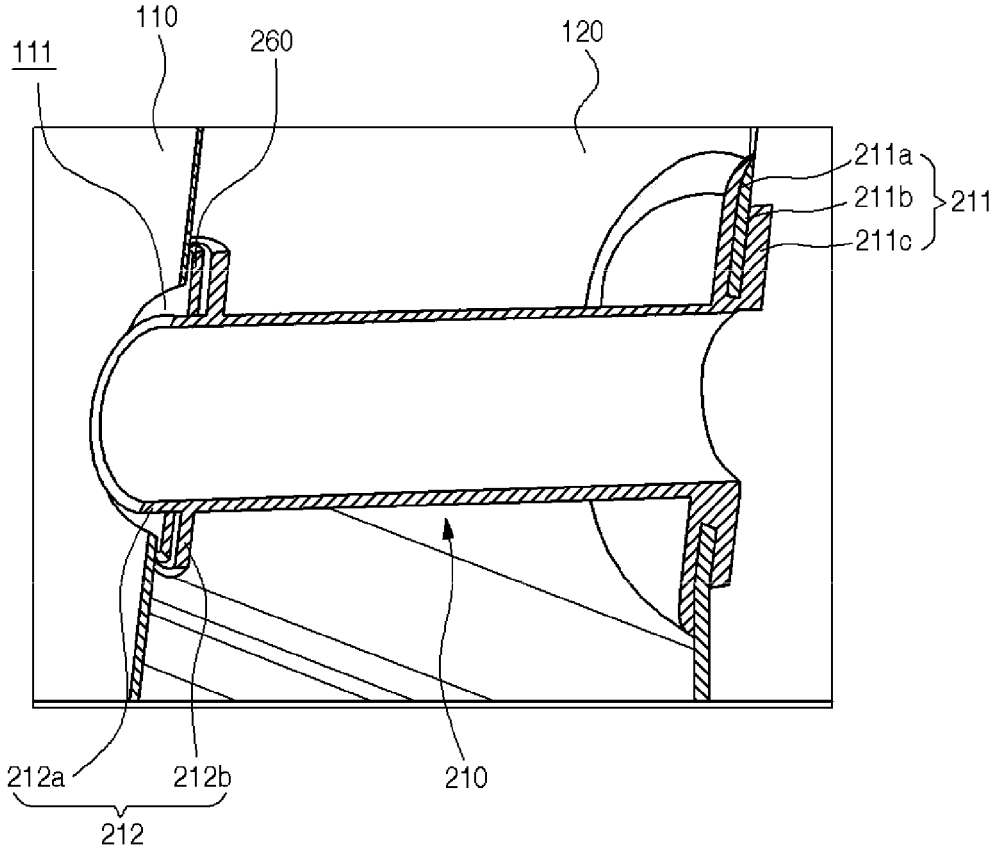
FIG. 4 is a cut-away perspective view illustrating an installation state of a connecting tube of the pressure adjustment device of FIG. 3.
Figure 5:
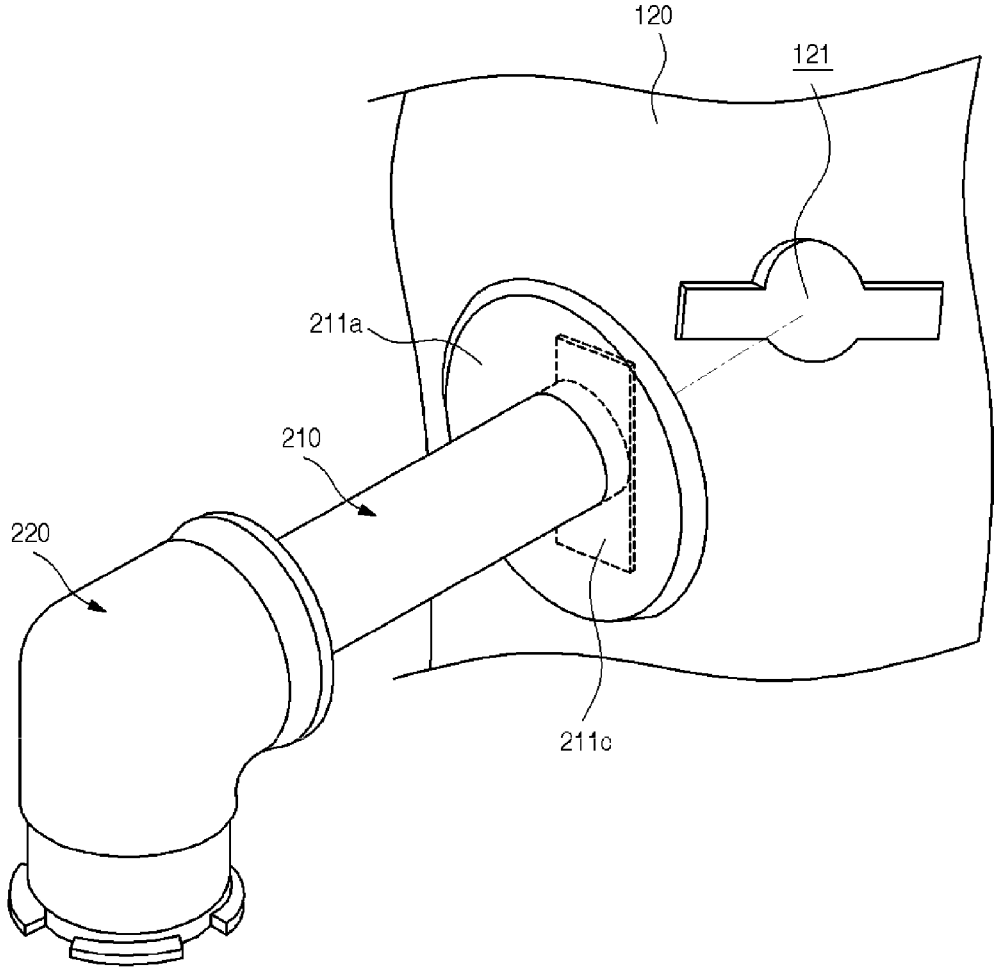
FIG. 5 is a perspective view illustrating the pressure adjustment device of FIG. 3.
Figure 6:
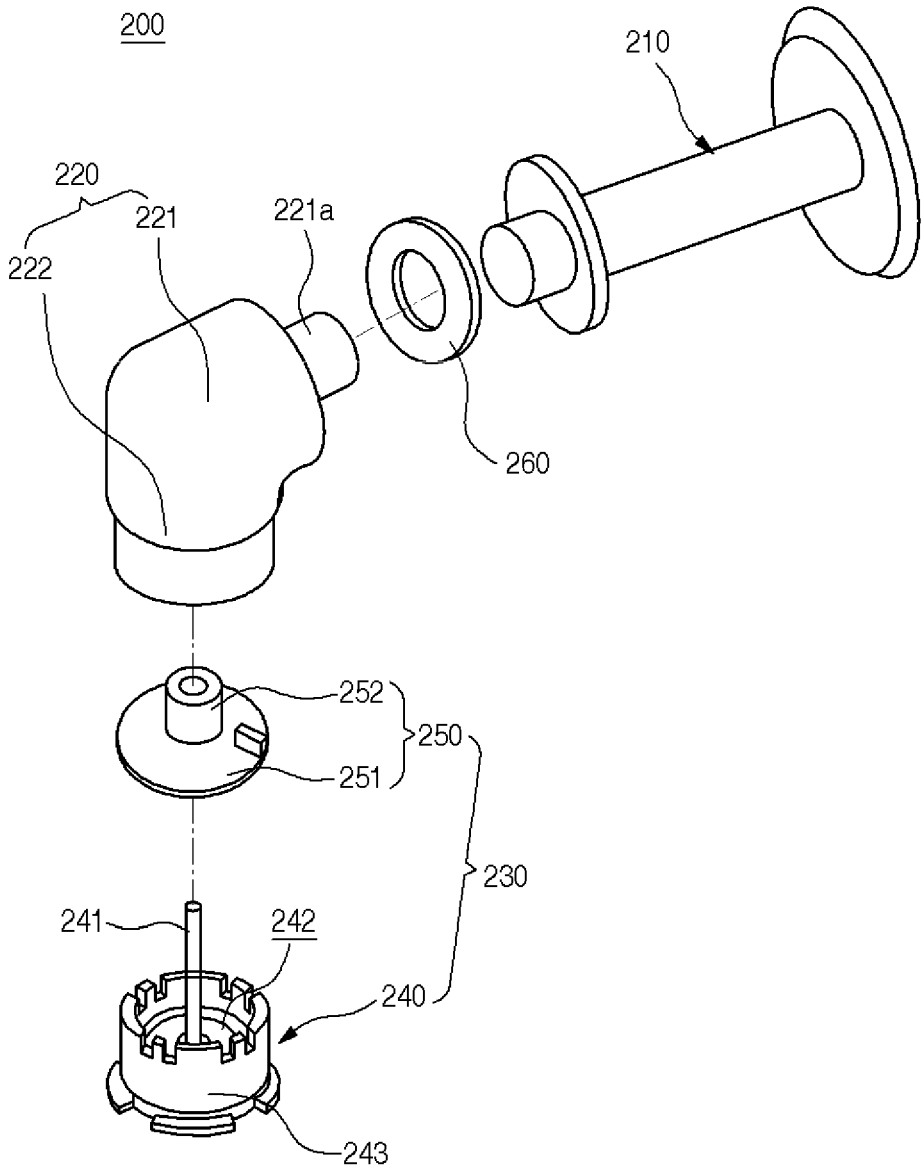
FIG. 6 is an exploded perspective view illustrating the pressure adjustment device of FIG. 3.

FIG. 3 is a cross-sectional view illustrating an installation state of a pressure adjustment device according to an embodiment. FIG. 4 is a cut-away perspective view illustrating an installation state of a connecting tube of the pressure adjustment device of FIG. 3. FIG. 5 is a perspective view illustrating the pressure adjustment device of FIG. 3. FIG. 6 is an exploded perspective view illustrating the pressure adjustment device of FIG. 3.

Referring to FIGS. 3 to 6, the pressure adjustment device 200 may be disposed at the upper side of the cabinet 10, and include: a connecting tube 210 passing through the cabinet 10; a main tube 220 disposed outside of the refrigerator 1 and connected to the connecting tube 210; and an opening/closing unit 230 disposed within the main tube 220.

In particular, the connecting tube 210 may pass through the cabinet 10, and have a hollow interior through which air flows. The ends of the connecting tube 210 are fixed to the inner case 120 and the outer case 110, respectively.

An inner case fixing part 211 is disposed at an end of the connecting tube 210 to fix the connecting tube 210 to the inner case 120. The inner case fixing part 211 extends outward from the end of the connecting tube 210. The inner case fixing part 211 includes a first fixing part 211*a* and a second fixing part 211*c*, which are spaced apart from each other. An insertion part 211*b* is disposed between the first fixing part 211*a* and the second fixing part 211*c*. The insertion part 211*b* is inserted into the inner case 120 to fix an end of the pressure adjustment device 200 to the inner case 120.

The first fixing part 211*a* has a dish shape and contacts an outer surface of the inner case 120 (a left surface on the basis of FIG. 3). The second fixing part 211*c* has a tetragonal plate shape and contacts an inner surface of the inner case 120 (a right surface on the basis of FIG. 3).

The second fixing part 211*c* extends upward and downward, that is, in opposite directions from the end of the connecting tube 210, and is inserted in an insertion hole 121 of the inner case 120 which has a shape corresponding to the second fixing part 211*c*. In order to fix the inner case fixing part 211 to the inner case 120, the second fixing part 211*c* is positioned such that the shape thereof matches the shape of the insertion hole 121, and is inserted into the insertion hole 121, and then, the connecting tube 210 is rotated through about 90° such that the second fixing part 211*c* crosses the insertion hole 121. At this point, the insertion part 211*b* between the first fixing part 211*a* and the second fixing part 211*c* is inserted in the inner case 120 so as to fix the end of the connecting tube 210.

An outer case fixing part 212 is disposed at the other end of the connecting tube 210 spaced apart from the first fixing part 211*a*. The outer case fixing part 212 may include: an extension part 212*a* passing through a through hole 111 of the outer case 110; and a support part 212*b* protruding outward from the extension part 212*a* to support the outer case 110.

The support part 212*b* has a disk shape and extends in a direction crossing the connecting tube 210 to support an inner surface of the outer case 110 (a right surface on the basis of FIG. 3). An end of the extension part 212*a*, which is passed through the through hole 111 and opened to the outside of the outer case 110, is exposed out of the cabinet 10. Thus, the distance between the first fixing part 211*a* and the support part 212*b* may correspond to the thickness of the cabinet 10.

A thermal insulating member 260 may be disposed between the outer case 110 and the support part 212*b*. The thermal insulating member 260 has a disk shape, through which the extension part 212*a* passes, and prevents the outer case 110 from being cooled by cold air passing through the connecting tube 210. That is, since cooling of the outer case 110 is prevented, frost is prevented from being formed on the outer surface of the outer case 110.

The main tube 220 may be installed on an outlet of the extension part 212*a*. The main tube 220, in which a perpendicularly bent passage is disposed, has an open end connected to the extension part 212*a*, and the other end oriented downward.

In particular, the main tube 220 may include a horizontal part 221 and a vertical part 222, and have a perpendicularly bent shape as a whole. A connecting part 221*a* is disposed at an end of the horizontal part 221. The connecting part 221*a* may be inserted in the extension part 212*a*, thereby coupling the connecting tube 210 and the main tube 220 to each other.

The opening/closing unit 230 may be disposed within the vertical part 222 to open and close the passage disposed in the main tube 220. The inside and outside of the refrigerator 1 are selectively connected to each other according to opening and closing of the opening/closing unit 230, so as to introduce and discharge outside air, for example.

The opening/closing unit 230 may include: a valve cap 240 fixed within the main tube 220; and a shutter 250 moving along respective to the valve cap 240 to open and close the passage of the main tube 220.

In particular, the valve cap 240 is fitted in the main tube 220 and closes the passage of the main tube 220. A guide shaft 241 vertically extends from the center of the valve cap 240 to vertically move the shutter 250 up and down. A peripheral part 243, which protrudes upward from an edge of the valve cap 240 and fixedly contacts the inner surface of the main tube 220, is inserted upward into the main tube 220 from the lower side thereof for coupling. An air passage 242, which is vertically opened, is disposed inside of the peripheral part 243. Thus, when the shutter 250 is opened, air can flow through the air passage 242.

The shutter 250 includes: a shutter plate 251 having a disk shape; and a boss 252 extending upward from the center of the shutter plate 251 and receiving the guide shaft 241. The shutter plate 251 may have a size to be inserted in the peripheral part 243, and completely close the air passage 242. The guide shaft 241 passes through the boss 252 and may have a predetermined length to stably move the shutter plate 251.

The guide shaft 241 extends from the valve cap 240 to an inner upper portion of the main tube 220, so that the shutter plate 251 can vertically move up and down to open and close the air passage 242.

Hereinafter, a process of assembling a refrigerator configured as described above, and an operation of a pressure adjustment device as described above will now be described according to an embodiment.

To assemble the refrigerator 1, the outer case 110 may be formed through bending, and the inner case 120 may be formed through injection molding. Then, the outer case 110 and the inner case 120 are coupled. At this point, a part of the outer case 110, constituting a rear surface of the cabinet 10, is not coupled to the outer case 110. In this state, the pressure adjustment device 200 is coupled to the inner case 120.

The second fixing part 211*c* of the connecting tube 210 is inserted into the insertion hole 121, and then, the connecting tube 210 is rotated through about 90°. Accordingly, the insertion part 211*b* between the first fixing part 211*a* and the second fixing part 211*c* is inserted into the inner case 120 so as to fix the end of the connecting tube 210 to the inner case 120.

In this state, the part of the outer case 110, constituting the rear surface of the cabinet 10, is coupled to the assembled other parts of the outer case 110. At this point, the through hole 111 disposed in the outer case 110 forming the rear surface of the cabinet 10 is located in a position corresponding to the extension part 212*a*. Thus, the extension part 212*a* protrudes through the through hole 111, and the support part 212*b* supports a portion of the outer case 110 surrounding the through hole 111.

At this point, the thermal insulating member 260 is located between the outer case 110 and the support part 212*b*. Thus, even in the case that cold air flows to the connecting tube 210, the outer case 110 is insulated from the cold air.

Then, the thermal insulator 130 is formed by filling the space between the outer case 110 and the inner case 120 with a foaming agent. After that, the main tube 220 is inserted into the end of the connecting tube 210 exposed out of the rear surface of the cabinet 10, that is, into the end of the extension part 212*a*.

The connecting part 221*a* of the main tube 220 may be inserted into the extension part 212*a* and be fixed. Since the opening/closing unit 230 is installed in the main tube 220 in advance, installation of the pressure adjustment device 200 is completed by coupling the main tube 220 and the connecting tube 210.

The opening/closing unit 230 is assembled by fitting the shutter 250 on the guide shaft 241 of the valve cap 240 to allow vertical movements of the shutter 250. The valve cap 240 with the shutter 250 is inserted into the open bottom of the main tube 220 to selectively open and close the passage of the main tube 220.

After the installation of the pressure adjustment device 200 is completed, when the refrigerator 1 is closed, the shutter 250 is moved downward by the weight thereof so as to close the air passage 242 of the valve cap 240. Accordingly, the inside and outside of the refrigerator 1 are separated from each other, so as to prevent air flow therebetween.

When opening of the door 20 is started in the state where the refrigerator 1 is closed, the inner pressure of the storage space 11 is decreased to cause a pressure difference between the inside and outside of the refrigerator 1. Accordingly, the shutter 250 moves upward.

At this point, the air passage 242 is opened, and outside air is introduced into the storage space 11 through the main tube 220 and the connecting tube 210 so as to remove the pressure difference between the inside and outside of the refrigerator 1, thereby facilitating the opening of the door 20.

A refrigerator according to various other embodiments will now be described.

Hereinafter, a refrigerator will now be described with reference to the accompanying drawings according to another embodiment.

According to the current embodiment, an end of a connecting tube of a pressure adjustment device is fixed to an inner case, and the other end thereof passes through an outer case.

Thus, since the rest of the parts of the current embodiment except for the pressure adjustment device and a portion of the outer case are the same as those of the previous embodiment, a description thereof will be omitted, and like reference numeral denote like elements.

Figure 7:
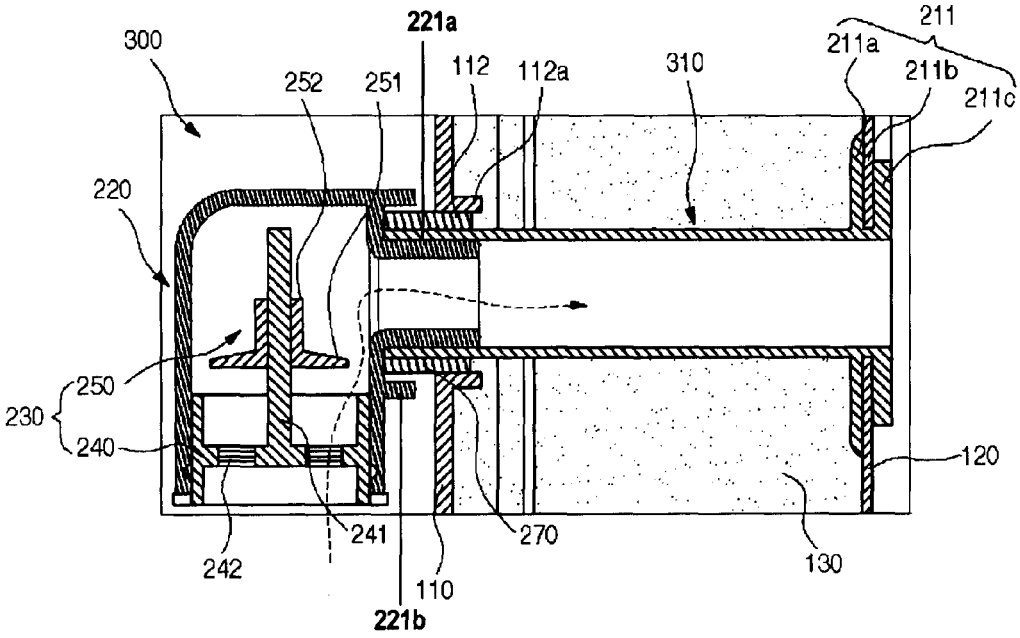
FIG. 7 is a cross-sectional view illustrating an installation state of a pressure adjustment device according to another embodiment.
Figure 8:
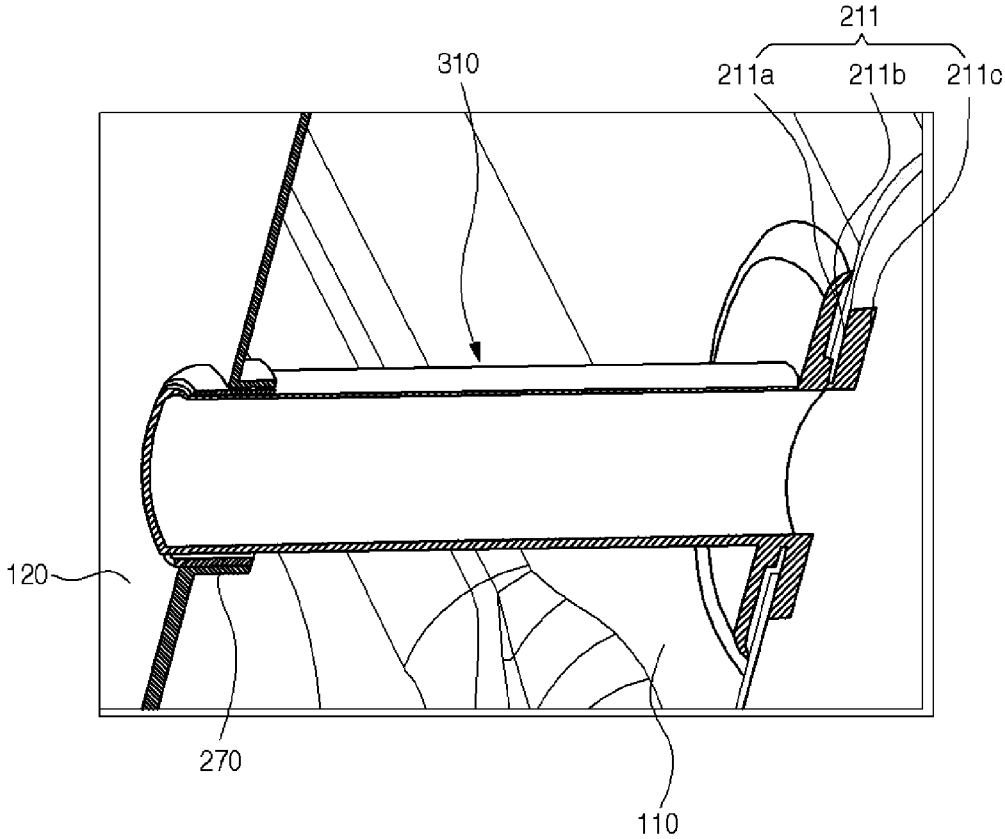
FIG. 8 is a cut-away perspective view illustrating an installation state of a connecting tube of the pressure adjustment device of FIG. 7.

FIG. 7 is a cross-sectional view illustrating an installation state of a pressure adjustment device according to the current embodiment. FIG. 8 is a cut-away perspective view illustrating an installation state of a connecting tube of the pressure adjustment device of FIG. 7.

Referring to FIGS. 7 and 8, a pressure adjustment device 300 is disposed at the upper side of a cabinet 10. The pressure adjustment device 300 may pass through an inner case 120 and an outer case 110 to connect the inside and outside of a refrigerator.

The pressure adjustment device 300 may include: a connecting tube 310 passing through the cabinet 10; a main tube 220 disposed outside of the cabinet 10 and connected to the connecting tube 310; and an opening/closing unit 230 disposed within the main tube 220 to selectively open and close an inner passage of the pressure adjustment device 300.

In particular, the connecting tube 310 has a hollow cylindrical shape and includes an inner case fixing part 211 at an end thereof. The inner case fixing part 211 includes a first fixing part 211*a* and a second fixing part 211*c*, which are spaced apart from each other. An insertion part 211*b* between the first fixing part 211*a* and the second fixing part 211*c* is fixedly inserted in the inner case 120.

An end of the connecting tube 310, which is opposite to the inner case fixing part 211, is protruded out of the cabinet 10 through a through hole 112 disposed in the outer case 110. A flange part 112*a* is disposed around the through hole 112 and is bent to the inside of the refrigerator. A thermal insulating member 270 is disposed between the flange part 112*a* and an outer surface of the connecting tube 310.

The thermal insulating member 270 prevents direct contact and thermal conduction between the connecting tube 310 and the flange part 112*a*. Thus, even in the case that cold air flows through the connecting tube 310, frost is prevented from being formed on the outer case 110. The thermal insulating member 270 is press-fit between the flange part 112*a* and the connecting tube 310, so as to seal the space between the connecting tube 310 and the flange part 112*a* and prevent leakage of a thermal insulator 130.

The end of the connecting tube 310, protruded out of the cabinet 10 through the through hole 112 of the outer case 110, may be coupled with the main tube 220. The main tube 220 includes a horizontal part 221 and a vertical part 222. A connecting part 221*a*, which is inserted in the connecting tube 310, is disposed at an end of the horizontal part 221. A receiving part 221*b* protrudes apart from the connecting part 221*a* and receives the end of the connecting tube and covers the thermal insulating member. The opening/closing unit 230 is disposed in the vertical part 222.

The opening/closing unit 230 may include a valve cap 240 and a shutter 250. The valve cap 240 may include an air passage 242 and a guide shaft 241. The shutter 250 may include: a shutter plate 251 having a disk shape; and a boss 252 extending upward from the center of the shutter plate 251 and receiving the guide shaft 241.

Since the pressure adjustment device 300 is the same as that of the previous embodiments except for a portion of the connecting tube 310, a description thereof will be omitted.

According to the embodiments, a refrigerator includes a pressure adjustment device passing through a cabinet without a defrosting passage structure. Thus, when a door is opened, a pressure difference between the inside and outside of the refrigerator is removed, thereby facilitating the opening of the door.

The pressure adjustment device may be assembled by fixing an end of a connecting tube to an inner case, coupling an outer case thereto, and then, connecting a main tube to the outer case from the outside thereof. Thus, the refrigerator is superior to a refrigerator including a pressure difference removing structure therein, in terms of assembling efficiency and productivity.

In addition, the main tube including an opening/closing unit is coupled to the cabinet from the outside thereof, and is exposed outside of the refrigerator. Thus, when the opening/closing unit is inappropriately operated or damaged, a repair service can be quickly and conveniently performed.

In addition, a thermal insulating member is disposed on an outer portion of the connecting tube contacting the outer case, to prevent thermal conduction from cold air moving along the connecting tube, thereby preventing frost from being formed on the outer case.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet including an outer case, an inner case and a thermal insulator filled between the outer case and the inner case, providing a storage space that is opened and closed by a door; and a pressure adjustment device disposed at the cabinet, wherein an inside of the refrigerator communicates with an outside thereof through the pressure adjustment device so as to remove a pressure difference between the inside and the outside of the refrigerator when the door is opened, wherein the pressure adjustment device comprises:

a connecting tube passing through the cabinet, an end of the connecting tube fixed in an insertion hole of the inner case and the other end of the connecting tube passing through a through hole of the outer case;

a flange defining through hole formed by bending the outer case toward inside of the cabinet;

a thermal insulating member is interposed between the flange and a peripheral surface of the connecting tube to prevent thermal conduction between the connecting tube and the outer case;

a main tube coupled to the connecting tube from the outside of the cabinet; and an opening/closing unit disposed within the main tube to open and close a passage of the pressure adjustment device, and wherein the main tube comprising:

a horizontal part provided with a connecting part that is disposed outside of the cabinet and is coupled to the connecting tube;

the connecting part extended from the horizontal part and inserted into the end of the connecting tube that protrudes outside of the through hole;

a receiving part protruded apart from the connecting part and receiving the end of the connecting tube and covering the thermal insulating member, and a vertical part bent downward from the horizontal part, wherein the opening/closing unit for opening and closing an air passage is disposed in the vertical part, and wherein the opening/closing unit comprises a valve cap, the valve cap is inserted in the vertical part and the valve cap covers a bottom opening of the vertical part.

2. The refrigerator according to claim 1, wherein the connecting tube is embedded in the thermal insulator.

3. The refrigerator according to claim 2, wherein the connecting tube comprises:

a first fixing part at an end thereof, which extends along a periphery of the connecting tube;

a second fixing part at the end thereof, which is spaced apart from the first fixing part and is extended from an outer surface of the connecting tube and is passed through the inner case; and an insertion part disposed between the first fixing part and the second fixing part to receive the inner case.

4. The refrigerator according to claim 3, wherein the second fixing part has a plate shape extending in opposite directions, and the inner case including an insertion hole having a shape corresponding to the second fixing part is disposed in the inner case such that an inner case fixing part is fixed by inserting the second fixing part into the insertion hole and rotating the second fixing part.

5. The refrigerator according to claim 1, wherein the thermal insulating member has a tube shape through which the connecting tube passes, and contacts the through hole.

6. The refrigerator according to claim 1, wherein the valve cap that comprises a guide shaft and an open passage, wherein the guide shaft is inserted into the vertical part from a lower side thereof, and is extended upward, and the open passage through which air flows is disposed outside of the guide shaft; and wherein the opening/closing unit further comprising a shutter vertically moving along the guide shaft to selectively open and close the open passage.

7. The refrigerator according to claim 2, wherein a refrigerant tube is disposed outside of the inner case to cool the inside of the refrigerator.

* * * * *